United States Patent [19]

Brotherston

[11] Patent Number: 4,474,156

[45] Date of Patent: Oct. 2, 1984

[54] GOVERNOR MECHANISM FOR A FUEL PUMPING APPARATUS

[75] Inventor: Colin P. Brotherston, Rainham, England

[73] Assignee: Lucas Industries Public Limited Company, Birmingham, England

[21] Appl. No.: 482,896

[22] Filed: Apr. 7, 1983

[30] Foreign Application Priority Data

May 1, 1982 [GB] United Kingdom ..... 8212745

[51] Int. Cl.[3] ..... F02D 31/00

[52] U.S. Cl. ..... 123/372; 123/373; 123/502

[58] Field of Search ..... 123/372, 373, 367, 368, 123/502

[56] References Cited

U.S. PATENT DOCUMENTS

| | | | |
|---|---|---|---|
| 3,923,026 | 12/1975 | Aoki | 123/372 |
| 4,000,728 | 1/1977 | Kurokawa | 123/373 |
| 4,095,574 | 6/1978 | Yoshino et al. | 123/373 |
| 4,143,634 | 3/1979 | Ritter et al. | 123/368 |
| 4,267,808 | 5/1981 | Djordjevic et al. | 123/367 |
| 4,313,409 | 2/1982 | Makino | 123/373 |
| 4,355,609 | 10/1982 | Skinner | 123/373 |
| 4,409,941 | 10/1983 | Haubenhofer | 123/502 |

FOREIGN PATENT DOCUMENTS

| | | | |
|---|---|---|---|
| 2051407 | 1/1981 | United Kingdom | 123/372 |

*Primary Examiner*—Magdalen Y. C. Moy

[57] ABSTRACT

A governor mechanism for controlling the setting of a fuel control member of a fuel pump includes a first lever located about a pivot. One end of the first lever is connected to the fuel control member and the first lever is urged in a direction to reduce the fuel delivered by a centrifugal mechanism. A second lever is engageable by the first lever and is urged in a direction to increase the amount of fuel delivered by a pre-stressed governor spring. The extent of movement of the second lever by the governor spring is limited by a maximum fuel stop and the pivot of the first lever is resiliently located by a spring which as the speed increases allows the pivot to move to increase the maximum amount of fuel which can be supplied by the fuel pump.

5 Claims, 5 Drawing Figures

GOVERNOR MECHANISM FOR A FUEL PUMPING APPARATUS

This invention relates to a governor mechanism for controlling in use, the setting of a fuel control member of a fuel injection pump of the kind intended to supply fuel to an internal combustion engine, the mechanism comprising a first pivotal lever connected in use to the fuel control member, a speed responsive mechanism coupled to said first lever and arranged so that with increasing speed an increasing force is applied to the lever in a direction to move the lever to reduce the amount of fuel supplied to the engine, a second pivotal lever, a main governor spring operatively connected to said second lever, said main governor spring comprising a prestressd spring, manually operable means operable through said main governor spring for altering the setting of said second lever, a maximum fuel stop operable to limit the movement of the second lever, said first and second levers being engageable with each other whereby as the manually operable means is moved in one direction, the fuel control member will be moved in a direction to increase the amount of fuel supplied and vice versa, the force exerted by said speed responsive mechanism exceeding the force required to deflect the main governor spring when in use, the engine speed rises above a predetermined value, and an idling spring operative in conjunction with the speed responsive mechanism to control the idling speed of the engine when said manually operable member is set to a minimum fuel position.

It is well known that some forms of injection pump exhibit a falling delivery speed characteristic meaning that when the maximum fuel stop is in operation, the amount of fuel delivered by the pump will decrease as the engine speed increases. The effect of this is that the maximum power available from the engine will reduce as the engine speed increases. It is also well known that some engines can tolerate an increase in the maximum amount of fuel supplied as the engine speed increases and a particular example of this type of engine is a turbo-supercharged engine where it is essential if the beneifts of turbo supercharging are to be obtained, to increase the maximum amount of fuel which can be supplied when the turbo supercharger becomes effective to increase the pressure of air supplied to the engine.

The object of the present invention is to provide a governor mechanism of the kind specified in a simple and convenient form.

According to the invention, a mechanism of the kind specified comprises a resilient means acting to locate the pivot of the first lever against movement by the force developed by said speed responsive mechanism, the force exerted by said resilient means being overcome as the speed of the associated engine increases, thereby allowing said first lever to be moved in a direction to move the fuel control member to increase the amount of fuel supplied to the engine.

An example of a governor mechanism in accordance with the invention will now be described with reference to the accompanying drawings, in which.

Figure 1:
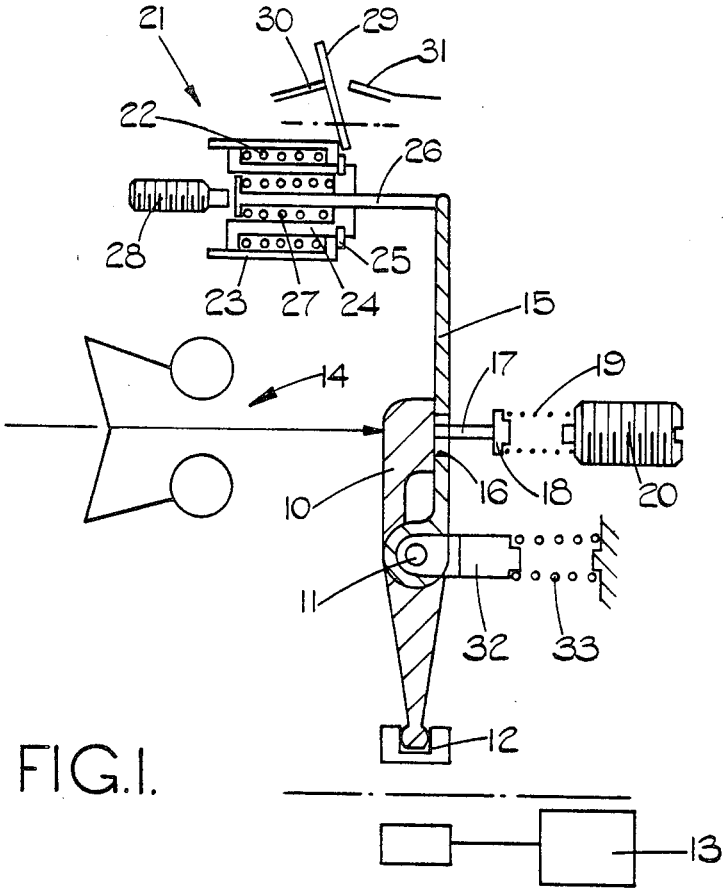
FIG. 1 is a diagrammatic representation of the governor mechanism.

Referring to FIG. 1 of the drawings, the governor mechanism comprises a first pivotal lever 10 which is pivotally mounted about a pivot 11. One end of the lever is coupled to an axially movable sleeve 12 which in turn is coupled to the fuel control member of a fuel injection pump 13. The other end of the lever 10 is engaged by the output member of a speed responsive mechanism generally indicated at 14, the mechanism in the particular example being a centrifugal weight mechanism.

Also provided is a second pivotal lever 15 which is pivotally mounted about the pivot 11. The other end of the lever 10 is shaped to define an abutment surface which can engage the lever 15 at a position removed from the pivot 11 and the lever 15 is provided with an aperture 16 through which extends a push rod 17 extending from a spring abutment 18 against which is located one end of an idling spring 19. The spring 19 is a coiled compression spring and its other end is located against an adjustable member 20.

The lever 15 is coupled to a main governor spring assembly generally indicated at 21 and this comprises a main governor spring 22 of the coiled compression type, which is located between an inwardly extending flange on a hollow outer cylindrical member 23 and an outwardly turned flange on an inner hollow cylindrical member 24. The spring 22 is held in a pre-stressed state by a circlip 25 which limits the extension of the spring. The lever 15 is pivotally connected to a rod 26 which extends through an aperture in the base wall of the cylindrical member 24 and which defines a head between which and the base wall of the member 24 is a coiled compression spring 27.

The head of the rod 26 is engageable with a maximum fuel stop 28 and a manually operable lever 29 is provided for engagement with the outer hollow cylindrical member 23, the extent of movement of the lever being limited by stops 30 and 31.

The pivot 11 is defined on a slidable block 32 and the block is biassed by a coiled compression spring 33 in a direction to oppose movement of the block 32 by the force exerted by the speed responsive mechanism.

The operation of the governor mechanism will now be described and in the initial description it will be assumed that the pivot 11 is fixed and that the spring 27 is solid.

Assuming also that the engine is operating in the intermediate speed range, the force exerted by the centrifugal mechanism 14 acts upon the lever 10 to urge the lever into contact with the lever 15. The actual position of the levers however will be determined by the manually operable lever 29 which through the governor spring 22 sets the position of the levers and it therefore determines the setting of the sleeve 12 and the amount of fuel which is supplied by the pump 13 to the associated engine. If the lever 29 is moved in the clockwise direction, anticlockwise movement will be imparted to the levers 10 and 15 and the sleeve 12 will be moved towards the right to increase the amount of fuel supplied to the engine. The maximum movement of the levers 10 and 15 in the anticlockwise direction is determined by the stop 28. If the lever 29 is moved in the opposite direction, then the amount of fuel supplied to the engine is reduced.

The force required to compress the main governor spring 22 and also the small force exerted by the idling spring 19, will only be developed when the engine speed approaches its maximum allowed value and when this occurs the speed responsive mechanism will move the levers 10 and 15 in the clockwise direction so compressing the spring 22 and reducing the amount of fuel supplied to the engine so that the maximum speed of the engine is controlled. If when the engine is running in the intermediate speed range, the lever 29 is moved into contact with the stop 30 which corresponds to minimum demand, the levers 10 and 15 will move under the action of the force exerted by the speed responsive mechanism, to reduce the fuel supplied to the engine to zero. With no fuel supplied the engine speed will decrease and the force exerted by the speed responsive mechanism will also decrease. A speed will be reched at which the force developed by the speed responsive mechanism is less than the force developed by the idling spring 19 and when this occurs, the lever 10 can then separate from the lever 15 and the speed responsive mechanism together with the idling spring 19 will constitute a governor to control the idling speed of the engine.

Figure 2:
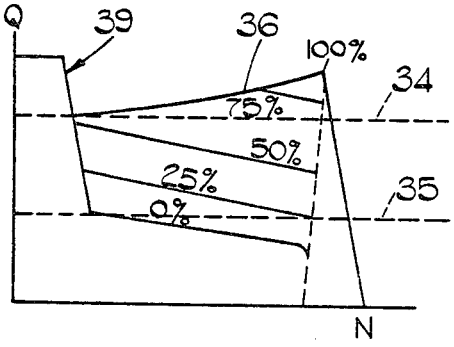
FIGS. 2 and 3 are graphs illustrating the operation of the mechanism.
Figure 3:
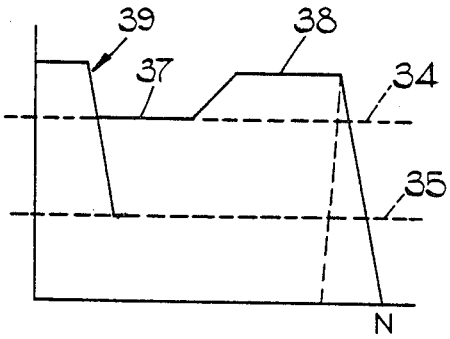

The graphs shown in FIGS. 2 and 3 include horizontal dotted lines 34, 35. The line 34 represents a maximum fuel level and the line 35 represents zero fuel, and with the arrangement as described, the maximum fuel level 34 is determined by the maximum fuel stop 28. As described, the governor is a "two-speed" governor and one of the disadvantages of the form of governor as described, is that the fuel cuts off sharply as the engine speed approaches its maximum value. Moreover, a further undesirable characteristic exhibits itself when the load on the engine is increasing as for example, when the vehicle is starting to climb a hill. Unless the operator of the vehicle can increase the amount of fuel there is a substantial risk that the engine will stall since the fuel supplied to the engine will remain constant irrespective of its speed.

In order to minimise the two effects above, the spring 27 is provided. The effect of this spring is to slope the fuel characteristic. As a result the fuel lines which appear between the lines 34 and 35 incline downwardly as the speed increases, so that the amount of power developed by the engine will gradually decrease as the engine speed increases. Conversely, as the engine speed falls the amount of fuel supplied to the engine will gradually increase, so that more power will be developed by the engine. This makes the driving of the vehicle with which the engine is associated much easier. The spring 27 in effect is connected in series with the spring 22 and acts in a similar manner to the governor spring of an "all-speed" governor.

As previously stated, some engines can tolerate an increase in the maximum amount of fuel which is supplied to the engine as the engine speed increases and this effect is achieved in the example by means of the spring 33. The force exerted by the spring 33 opposes the force exerted by the speed responsive mechanism 14 and as the engine speed increases, there will be a tendency for the levers 10 and 15 to pivot about the connection point of the lever 15 with the rod 26. As a result, the sleeve 12 is moved towards the right to effect an increase in the maximum amount of fuel which can be supplied to the engine. This is shown by the line 36 in FIG. 2. The stop 28 determines the lowest point of the maximum fuel line.

In FIG. 3 it will be noted that the maximum fuel line has a distinct step. This is again obtained using the spring 33 and is particularly designed for use with a turbo supercharged engine. At low engine speeds and loads, the turbo supercharger will not be particularly effective to increase the pressure of air in the air inlet manifold of the engine. The quantity of fuel which can be supplied to the combustion chambers of the engine must therefore be kept at a level more appropriate to a naturally aspirated engine. When the turbo supercharger becomes effective, the amount of air supplied to the engine cylinders will be increased and hence more fuel can be supplied to the engine. The maximum fuel line in FIG. 3 is divided into a portion 37 and a portion 38, the latter prevailing when the turbo supercharger is effective.

In FIGS. 2 and 3 there is shown a region which is referenced 39 where the fuel level is substantially higher. This is for the purpose of starting the engine and can be achieved by pivoting the lever 10 in the anitclockwise direction by a special mechanism not shown or by using the force exerted by the idling spring 19.

In the example described above the maximum fuel stop 28 engages with the head of the rod 26. An alternative position for the maximum fuel stop is such that it can engage the cylindrical member 23. In this case the spring 27 also influences the governor characteristics.

In practice it is difficult to locate the various components in physical positions corresponding to FIG. 1 and in a practical construction the pivot 11 is defined by a pin carried in a cradle structure which is hinged about an axis disposed between the pivot 11 and the contacting faces of the levers 10 and 15. The cradle structure has an extension on the opposite side of the hinge axis to the pivot 11, the extension being coupled to the spring 33. The spring is disposed at a position which is offset from the plane containing the lever 10.

Figure 4:
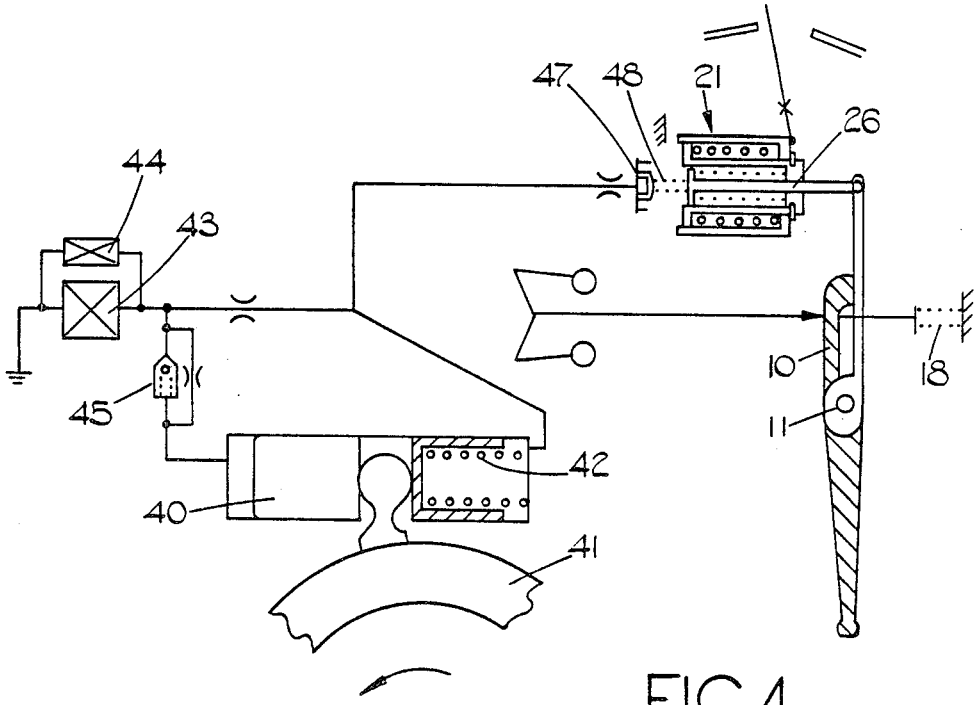
FIGS. 4 and 5 show additional components which can be added to the mechanism of FIG. 1 to provide timing control.

The pump with which the governor mechanism is associated may need means to vary the timing of delivery of fuel. Such means may take the form of a fluid pressure operable piston and the pressure of fluid applied to the piston can be controlled by a valve associated with the rod 26. The position of the rod 26 is representative of the amount of fuel being supplied to the engine and hence if the valve is a spring loaded valve, and the force applied to the valve member by its spring is controlled by the position of the rod 26, then the fluid pressure applied to the piston can be controlled so that it varies in accordance with the amount of fuel being supplied to the engine. FIG. 4 shows an example of such an arrangement, the piston being indicated at 40 and shown connected to a cam ring 41 of a distributor type fuel pump. The piston is loaded by a spring 42 in a direction to retard the timing of fuel delivery. Fuel under pressure is applied to the end of the piston remote from the spring from a fuel supply pump 43 the output pressure of which is controlled by a valve 44. An anti-shock valve 45 is interposed between the pump and the piston.

The force exerted by the spring 42 is supplemented by fuel pressure which is derived from the outlet of the pump 43 by way of a restrictor 46 and a valve 47 controlled by the rod 26 determines the pressure downstream of the restrictor. The valve 47 includes an orifice controlled by a valve member which is biased to close the orifice by means of a spring 48 interposed between the valve member and the head of the rod 26.

Figure 5:
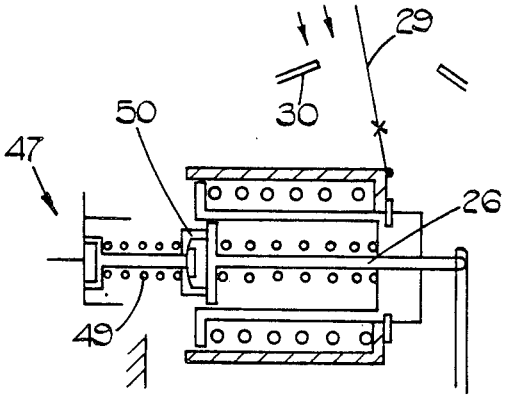

In the arrangement shown in FIG. 5 the spring 49 which controls the valve 47 is a preloaded spring and it is arranged that when the control lever 29 is released, it being spring biased towards the stop 30, a clearance is established between a cup shaped washer 50 and the head on the rod 26. The valve member of the valve 47 is therefore allowed to move away from the valve orifice so that the fuel pressure acting to supplement the spring 42 is reduced to substantially zero, thereby allowing the piston to move under the action of the fuel pressure further against the action of the spring 42 resulting in advancement of the timing of fuel delivery.

I claim:

1. A governor mechanism for controlling in use, the setting of a fuel control member of a fuel injection pump intended to supply fuel to an internal combustion engine, the mechanism comprising a first pivotal lever connected in use to the fuel control member, a speed responsive mechanism coupled to said first lever and arranged so that with increasing speed an increasing force is applied to the lever in a direction to move the lever to reduce the amount of fuel supplied to the engine, a second pivotal lever, a main governor spring operatively connected to said second lever, said main governor spring comprising a prestressed spring, manually operable means operable through said main governor spring for altering the setting of said second lever, a maximum fuel stop operable to limit the movement of the second lever, said first and second levers being engageable with each other whereby as the manually operable means is moved in one direction, the fuel control member will be moved in a direction to increase the amount of fuel supplied and vice versa, the force exerted by said speed responsive mechanism exceeding the force required to deflect the main governor spring when in use, the engine speed rises above a predetermined value, an idling spring operative in conjunction with the speed responsive mechanism to control the idling speed of the engine when said manually operable member is set to a minimum fuel position, a resilient means acting to locate the pivot of the first lever against movement by the force developed by said speed responsive mechanism, the force exerted by said resilient means being overcome as the speed of the associated engine increases, thereby allowing said first lever to be moved in a direction to move the fuel control member to increase the amount of fuel supplied to the engine.

2. A mechanism according to claim 1 in which said idling spring acts upon said first lever.

3. A mechanism according to claim 1 including wherein said maximum fuel stop is operable to limit the movement of said second lever in the direction to increase the amount of fuel.

4. A mechanism according to claim 3 including further resilient means connected in series with the main governor spring.

5. A mechanism according to claim 1 including valve means connected to said second lever said valve means in use, acting to control a fluid pressure within the associated pump.

* * * * *